US009267293B1

(12) United States Patent
Li

(10) Patent No.: US 9,267,293 B1
(45) Date of Patent: Feb. 23, 2016

(54) HAND RAILINGS

(71) Applicant: Jia-Hao Li, Changhua (TW)

(72) Inventor: Jia-Hao Li, Changhua (TW)

( * ) Notice: Subject to any disclaimer, the term of this patent is extended or adjusted under 35 U.S.C. 154(b) by 0 days.

(21) Appl. No.: 14/622,629

(22) Filed: Feb. 13, 2015

(51) Int. Cl.
*E04H 17/14* (2006.01)
*E04F 11/18* (2006.01)
*E04F 11/02* (2006.01)

(52) U.S. Cl.
CPC ..... *E04F 11/1808* (2013.01); *E04F 11/18* (2013.01); *E04F 2011/0203* (2013.01); *E04F 2011/1868* (2013.01)

(58) Field of Classification Search
CPC ..... E04F 11/1808; E04F 11/18; E04F 2011/1863; E04F 2011/0203; E04F 11/1842; E04F 2011/181; E04F 2011/1897; E04F 2011/1868; E04F 2011/18978
USPC ..... 52/720.2, 33, 720.1; 256/59, 66, 69
See application file for complete search history.

(56) References Cited

U.S. PATENT DOCUMENTS 2,816,052 A * 12/1957 Fischer et al. ..... 148/599
3,748,802 A * 7/1973 Verderio ..... 52/187
3,793,411 A * 2/1974 Stonitsch et al. ..... 264/46.5
3,979,186 A * 9/1976 Mizuma ..... 428/573
4,313,697 A * 2/1982 Rozanc ..... 405/259.6
4,858,891 A * 8/1989 Boes ..... 256/19
4,953,830 A * 9/1990 Weaver, III ..... 256/65.02
5,613,664 A * 3/1997 Svalbe ..... 256/19
5,626,331 A * 5/1997 Erwin ..... 256/59
5,957,437 A * 9/1999 Savenok ..... 256/65.13
6,240,698 B1 * 6/2001 Chung ..... 52/832
6,305,670 B1 * 10/2001 Ward et al. ..... 256/59
6,431,526 B1 * 8/2002 Guerra et al. ..... 256/59
6,841,108 B1 * 1/2005 Savenok ..... 264/162
6,993,237 B2 * 1/2006 Cooke et al. ..... 385/135
7,591,286 B2 * 9/2009 Howard ..... 138/161
7,971,412 B1 * 7/2011 Lim ..... 52/832
2004/0003568 A1 * 1/2004 McCarthy ..... 52/720.2
2006/0107613 A1 * 5/2006 Chung ..... 52/720.2
2011/0089390 A1 * 4/2011 Steinkraus ..... 256/65.02
2011/0155880 A1 * 6/2011 Stimpson ..... 248/285.1
2014/0246639 A1 * 9/2014 Lee ..... 256/65.1

* cited by examiner

*Primary Examiner* — Syed A Islam
*Assistant Examiner* — Joshua Ihezie
(74) *Attorney, Agent, or Firm* — Che-Yang Chen; Law Office of Michael Chen

(57) ABSTRACT

A hand railing includes a metal rod, a plurality of positioning units and a plastic cover. The positioning units are adapted to be secured on the surface of the metal rod. The metal rod is then placed in the injection mold, and the positioning unit is disposed between the metal rod and injection mold. The melted plastic cover is then introduced into the mold to fill the mold including the recessed portions and melt the surface of the positioning unit, so the plastic cover can completely cover the metal rod and the positioning unit. Furthermore, since the melted plastic cover also flows into recessed slot, the engagement between the metal rod and plastic cover is even stronger.

10 Claims, 12 Drawing Sheets

HAND RAILINGS

FIELD OF THE INVENTION

The present invention is related to a railing structure, and more particularly to a railing structure that is covered by plastic and has high manufacturing yields.

BACKGROUND OF THE INVENTION

Referring to FIG. 15, a metal rod 61 is inserted into a railing 60, and both ends of the metal rod 61 are secured against a molding apparatus. A plastic cover 62 is then covered the surface of the metal rod through an injection molding process and both ends of the plastic cover 62 have threaded portions 621, so the railing 60 can be secured vertically at the edge of a terrace through the threaded portions 621 and the railing 60 can be used for safety concerns.

However, conventional railing structure is disadvantageous because during the manufacturing process, the metal rod 61 is disposed in the molding directly and secured only at two ends thereof, so the metal rod 61 is not secured at the center portion of the molding. Also, when the metal rod 61 is in contact with the molding, the plastic cannot cover the contacted area of the metal rod 61, which would lead to a bad product and reduce the yield. Also, two ends of the metal rods are used to secure the metal rod 61 in the molding, so the plastic cannot cover the ends as well, so the metal rod 61 is easy to be separated from the plastic 62. Therefore, there remains a need for a new and improved hand railing structure to overcome the problems stated above.

SUMMARY OF THE INVENTION

To solve the problems stated above, the present invention provides a hand railing including a metal rod, a plurality of positioning units and a plastic cover. The metal rod has a first end and a second end, and a recessed slot extending from the first end to the second end is formed on a surface of the metal rod. The recessed slot is a slanted slot continuously extending from the first end to the second end. The positioning unit is formed as one unit, and a pair of cover bodies and are symmetrically formed on both sides of the positioning unit, and a connecting portion is used to connect the cover bodies. A concave arc surface is formed on the side that the cover bodies face each other. The cover body has a reverse hook portion while the cover body has a fixed hole. The concave arc surfaces are used to attach to the surface of the metal rod, and the reverse hook portion plugs into the fixed hole to secure the positioning unit on the metal rod. At least one protruding particle is formed on the arc surfaces to insert into the recessed slot on the metal rod to further secure the positioning unit on the metal rod. Furthermore, the metal rod is disposed in a mold during the inject molding process and the positioning unit is disposed between the mold and the metal rod. A plurality of recessed portions are formed on the surface of the positioning unit so the plastic cover can flow to cover the surface of the metal rod and flow into the recessed slot when it is melted. The plastic cover is adapted to cover the positioning unit by melting the surface thereof. A plurality of stopping portions are both sides of the metal rod, and a ring section of the plastic cover is formed at the first end of the metal rod while a screw section is formed at the second end of the metal rod. A longitudinal section is protrudingly formed on the metal rod from the ring section, and a plurality of reverse hook blocks are protrudingly formed near the ring section, so the ring section and the screw section are arranged to form the hand railing and the stopping portion is used as a protection thereof.

In one embodiment, the recessed slot is a continuously slanted slot extending from the first end to the second end.

In another embodiment, the recessed slot is a spacedly-arranged ring recessed slot extending from the first end to the second end.

In a further embodiment, the recessed slot is a straight recessed slot extending from the first end to the second end.

In still a further embodiment, the recessed slot can be evenly distributed between the first end and second end.

Comparing with conventional hand railings, the present invention is advantageous because the connecting portion is used to open up the cover bodies, and the arc surfaces cover the surface of the metal rod, so the reverse hook portion and fixed hole are engaged so the positioning units are secured on the surface of the metal rod. The metal rod is then placed in the injection mold, and the positioning unit is disposed between the metal rod and injection mold. Meanwhile, the melted plastic cover is introduced into the mold to fill the mold including the recessed portions and melt the surface of the positioning unit, so the plastic cover can completely cover the metal rod and the positioning unit. Furthermore, since the melted plastic cover also flows into recessed slot, the engagement between the metal rod and plastic cover is even stronger. The manufacturing yield can also be increased because of the positioning units.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
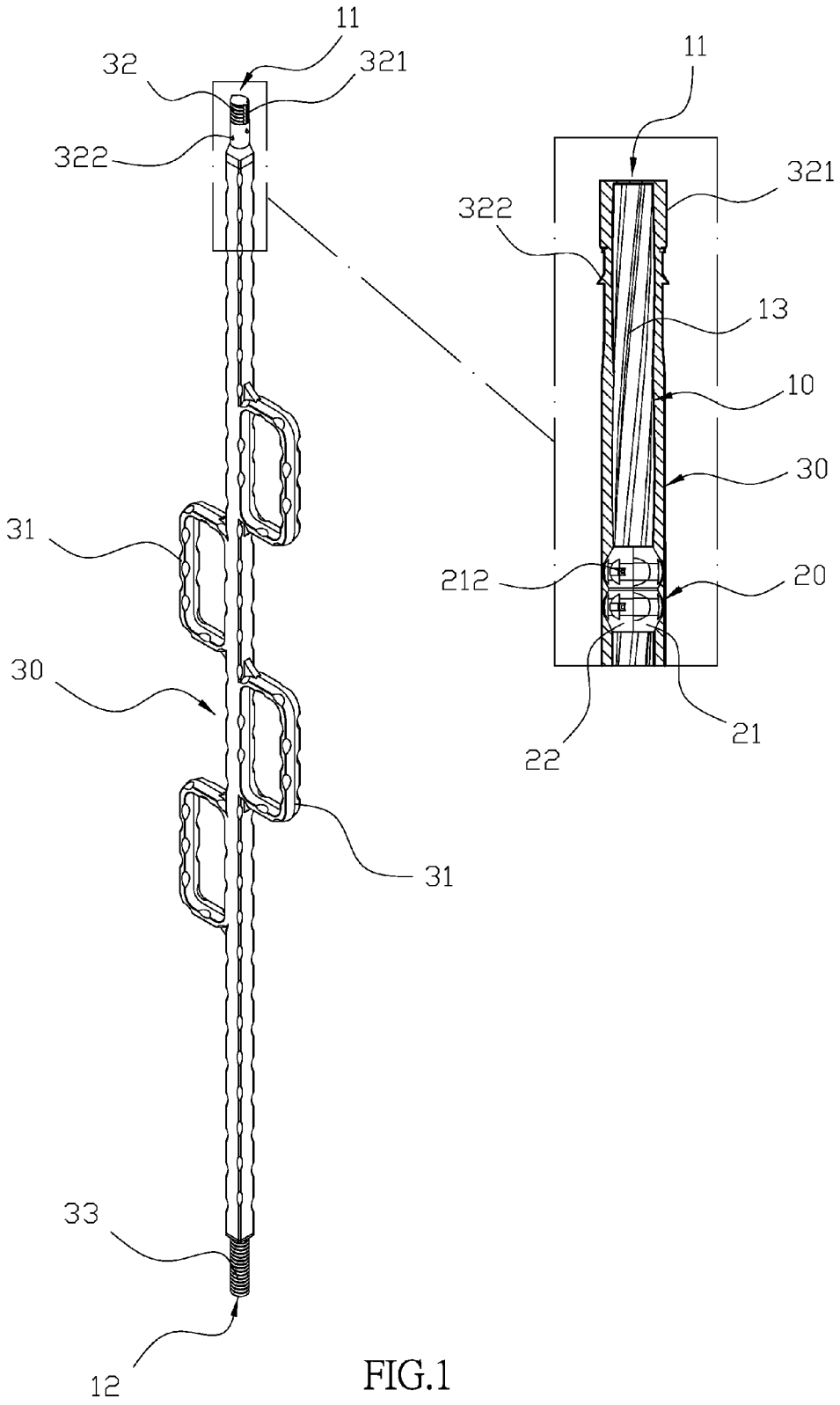
FIG. 1 illustrates a three-dimensional and partial sectional view in the present invention.
Figure 2:
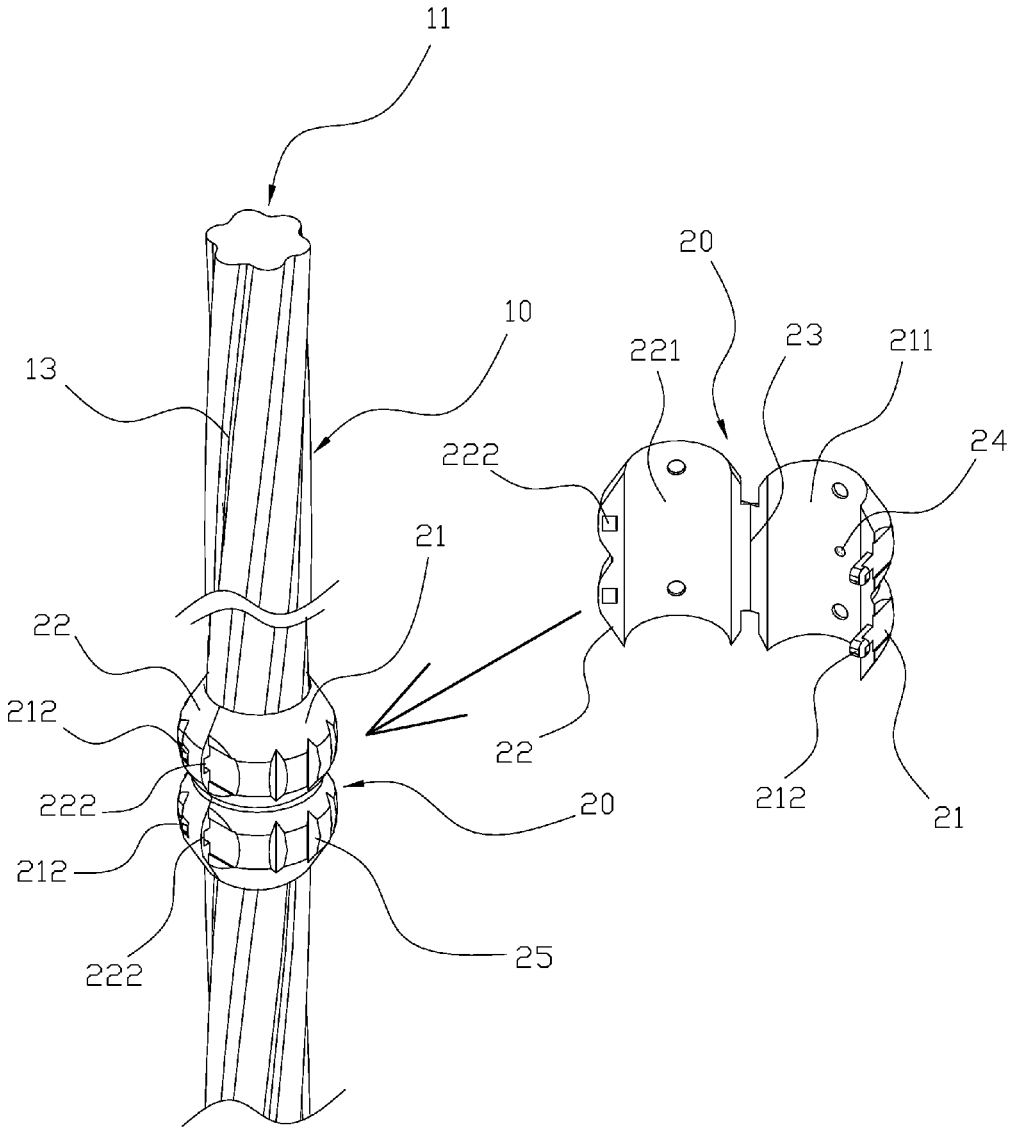
FIG. 2 illustrates an exploded view of the metal rod and positioning unit in the present invention.
Figure 3:
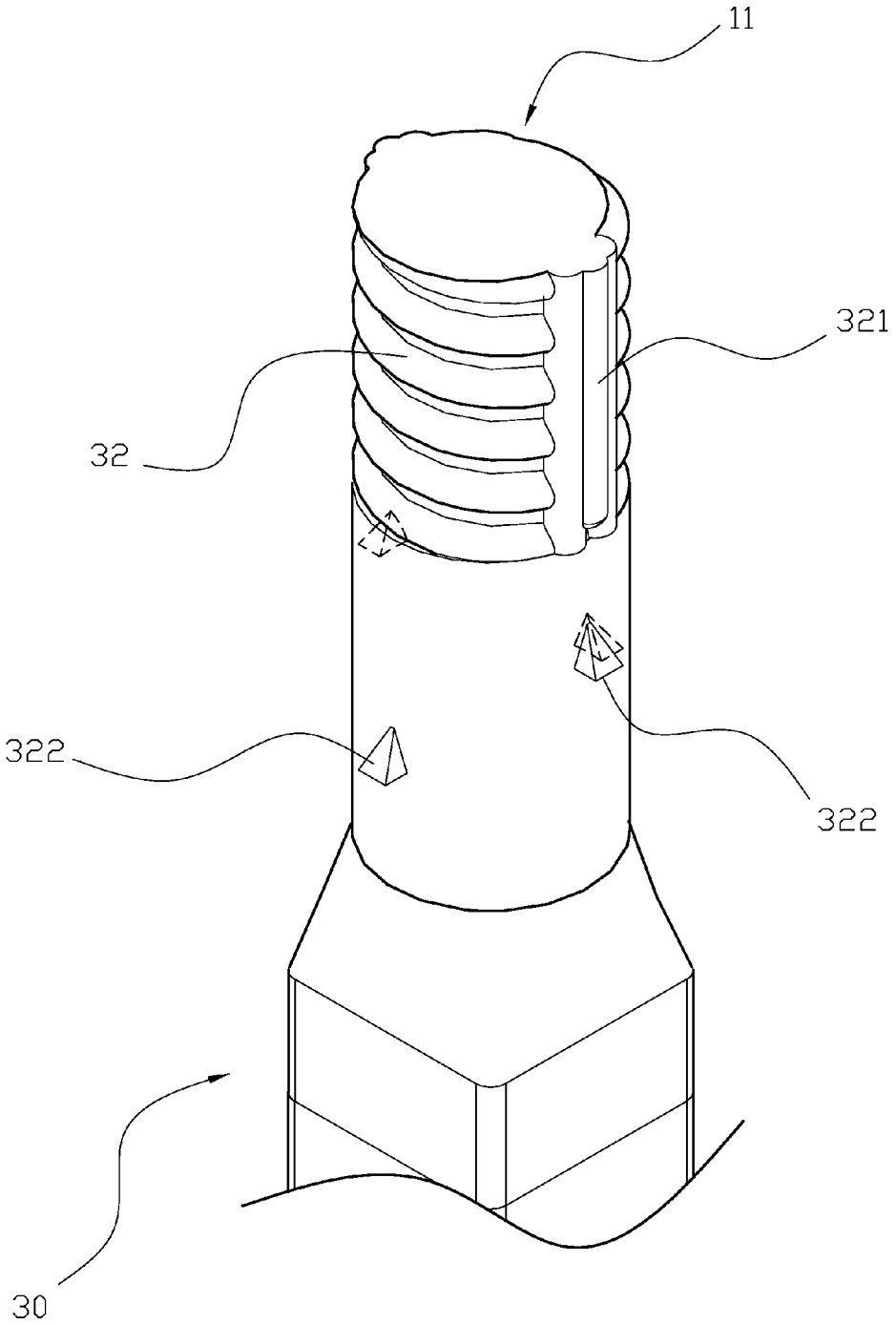
FIG. 3 illustrates a three-dimensional view of the first end in the present invention.
Figure 4:
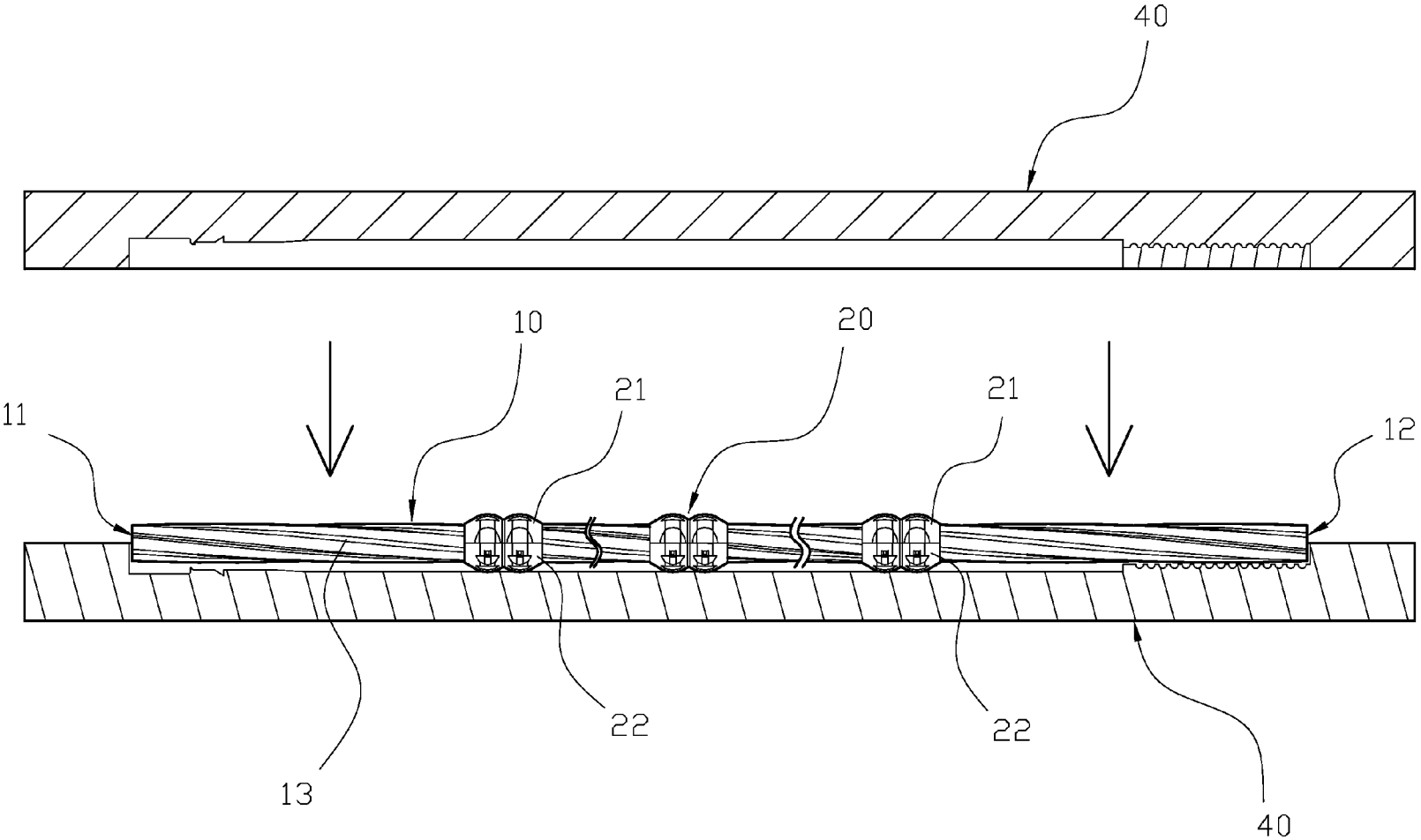
FIG. 4 illustrates a first schematic view of the manufacturing process in the present invention.
Figure 5:
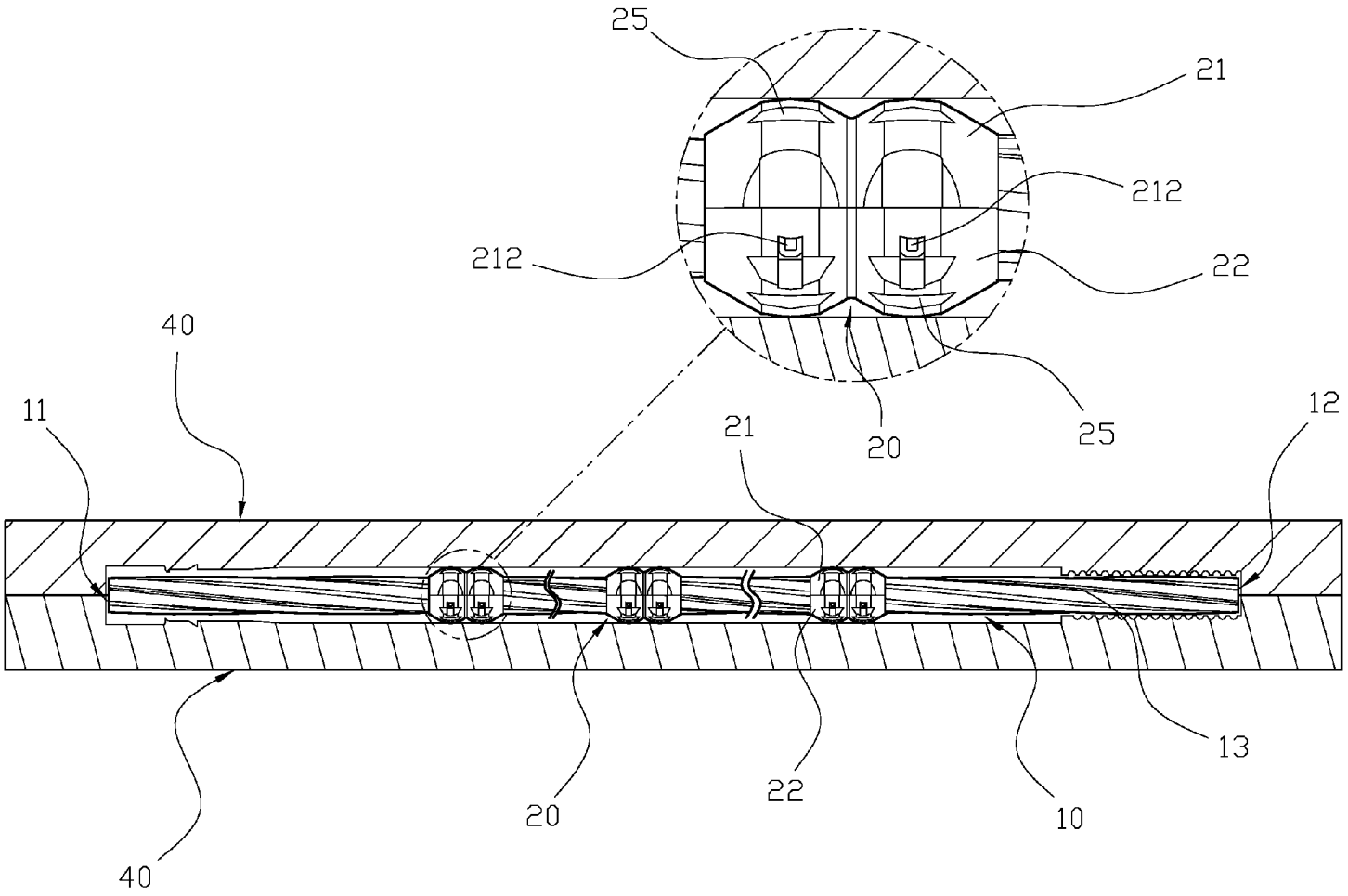
FIG. 5 illustrates a second schematic view of the manufacturing process in the present invention.
Figure 6:
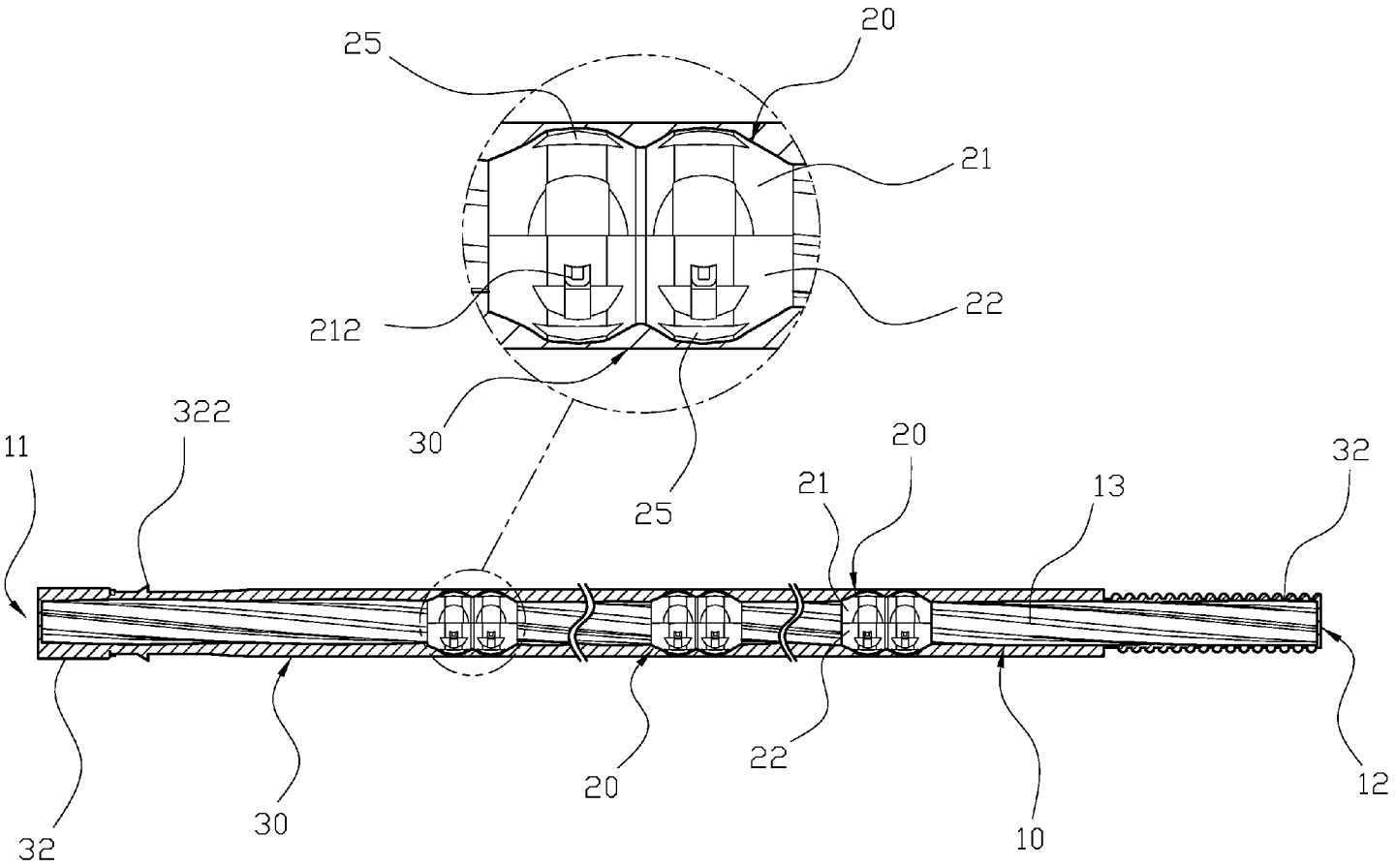
FIG. 6 is a third schematic view of the manufacturing process in the present invention.
Figure 7:
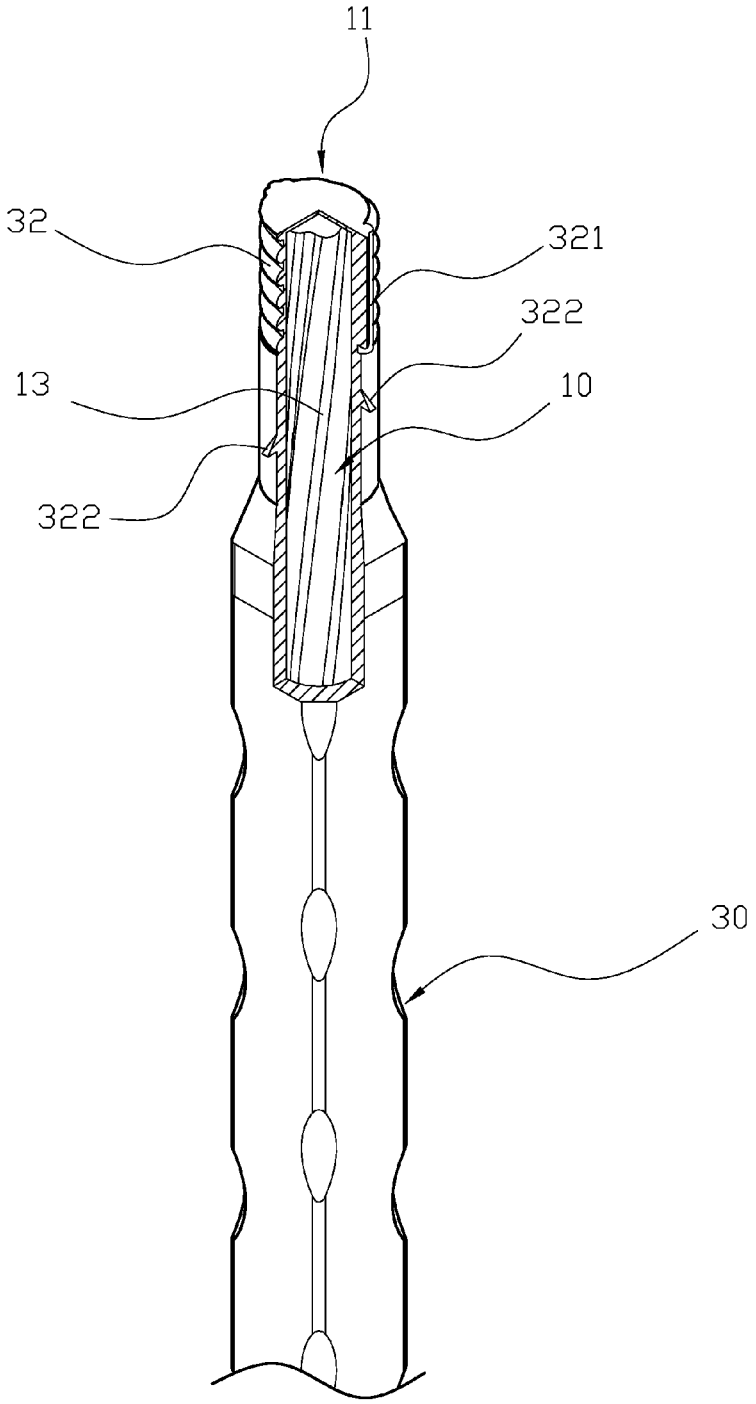
FIG. 7 is three-dimensional and partial sectional view in the present invention.

In order to further understand the goal, characteristics and effect of the present invention, a number of embodiments along with the drawings are illustrated as following:

Referring to FIGS. 1 to 2, a hand railing includes a metal rod 10, a plurality of positioning units 20 and a plastic cover 30. The metal rod 10 has a first end 11 and a second end 12, and a recessed slot 13 extending from the first end 11 to the second end 12 is formed on a surface of the metal rod 10. The recessed slot 13 is a slanted slot continuously extending from the first end 11 to the second end 12. The positioning unit 20 is formed as one unit, and a pair of cover bodies 21 and 22 are symmetrically formed on both sides of the positioning unit 20, and a connecting portion 23 is used to connect the cover bodies 21 and 22. A concave arc surface 211 and 221 is formed on the side that the cover bodies 21 and 22 face each other. The cover body 21 has a reverse hook portion 212 while the cover body 22 has a fixed hole 222. The concave arc surfaces 211 and 221 are used to attach to the surface of the metal rod 10, and the reverse hook portion 212 plugs into the fixed hole 222 to secure the positioning unit 20 on the metal rod 10. At least one protruding particle 24 is formed on the arc surfaces 211 and 221 to insert into the recessed slot 13 on the metal rod 10 to further secure the positioning unit 20 on the metal rod 10. Furthermore, the metal rod 10 is disposed in a mold 40 during the inject molding process and the positioning unit 20 is disposed between the mold 40 and the metal rod 10. A plurality of recessed portions 25 are formed on the surface of the positioning unit 20 so the plastic cover 30 can flow to cover the surface of the metal rod 10 and flow into the recessed slot 13 when it is melted. The plastic cover 30 is adapted to cover the positioning unit 20 by melting the surface thereof. A plurality of stopping portions 31 are both sides of the metal rod 10, and a ring section 32 of the plastic cover 30 is formed at the first end 11 of the metal rod 10 while a screw section 33 is formed at the second end 12 of the metal rod 10. Referring to FIG. 3, a longitudinal section 321 is protrudingly formed on the metal rod 10 from the ring section 32, and a plurality of reverse hook blocks 322 are protrudingly formed near the ring section 32, so the ring section 32 and the screw section 33 are arranged to form the hand railing and the stopping portion 31 is used as a protection thereof.

Referring to FIGS. 1 to 7, the resilient connecting portion 23 is adapted to open up the cover bodies 21 and 22, and the arc surfaces 211 and 221 cover the surface of the metal rod 10, so the reverse hook portion 212 and fixed hole 222 are engaged so the positioning units 20 are secured on the surface of the metal rod 10. The metal rod 10 is then placed in the injection mold 40 and the positioning units 20 is disposed between the metal rod 10 and injection mold 40. Meanwhile, the melted plastic cover 30 is introduced into the mold 40 to fill the mold 40 including the recessed portions 25 and melt the surface of the positioning unit 20, so the plastic cover 30 can completely cover the metal rod 10 and the positioning unit 20. Furthermore, since the melted plastic cover 30 also flows into recessed slot 13, the engagement between the metal rod 10 and plastic cover 30 is even stronger. The ring section 32 and the screw section 33 are respectively formed on the first end and second end of the metal rod 10, while the stopping portion 31 is formed as a protection, and the hand railing structure is thus formed.

Figure 8:
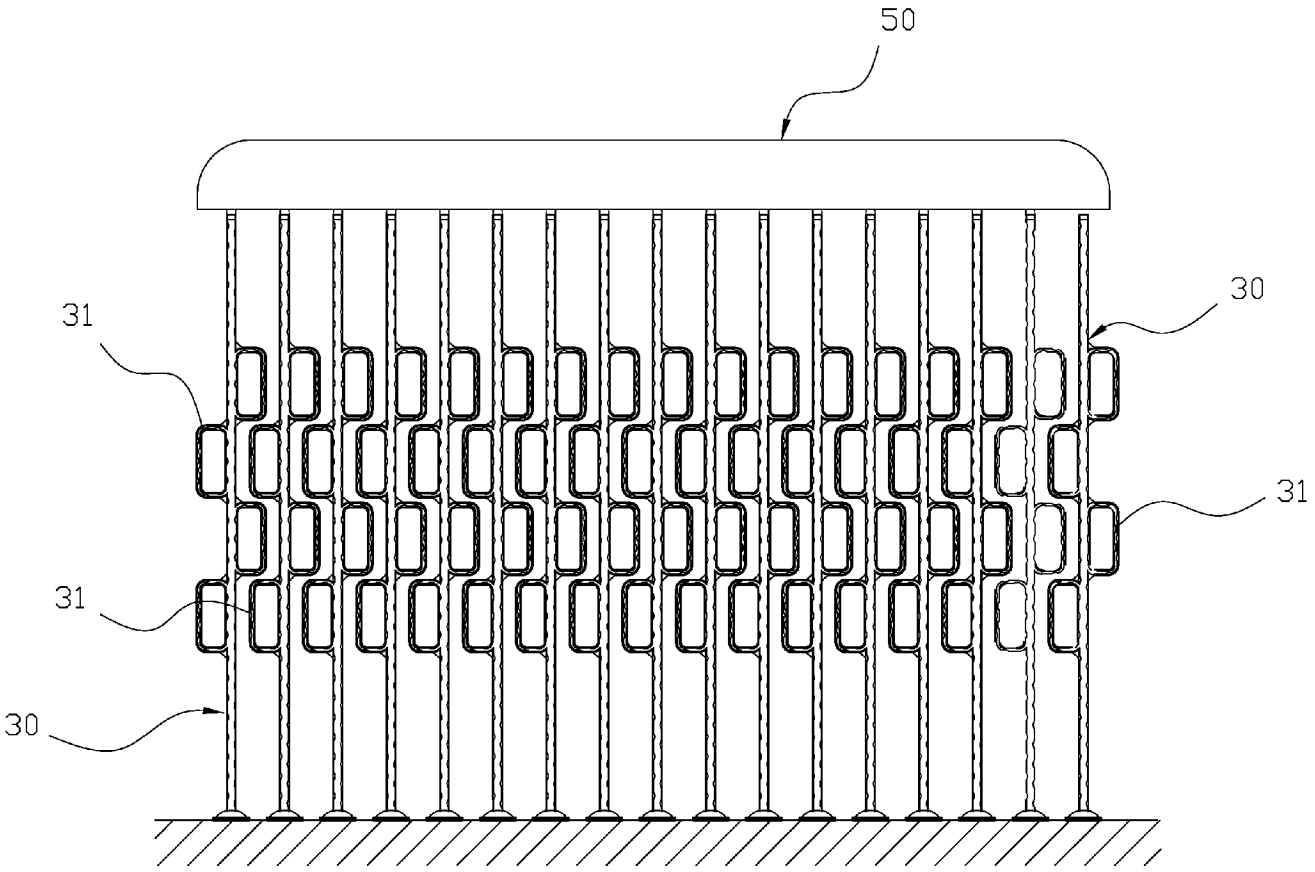
FIG. 8 is a first schematic view of the hand railing in the present invention.
Figure 9:
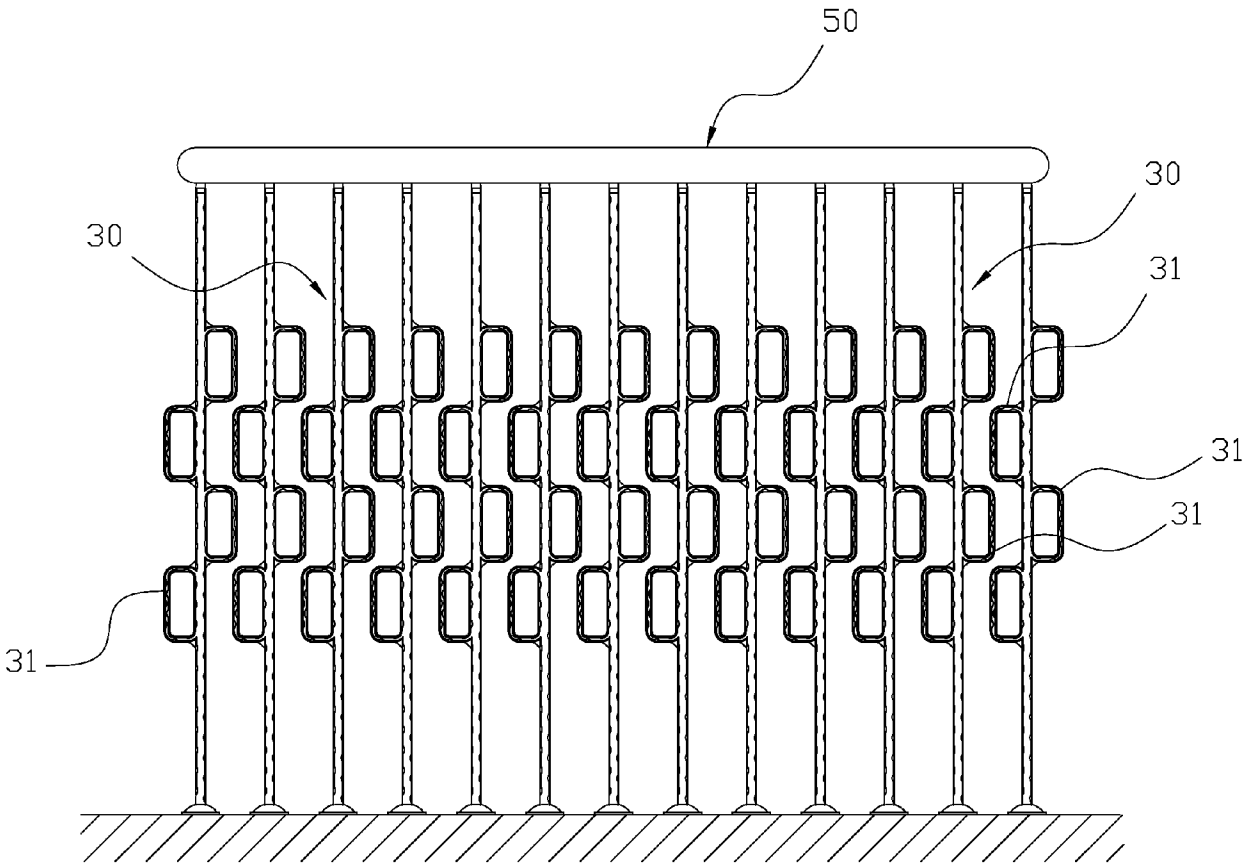
FIG. 9 is a second schematic view of the hand railing in the present invention.
Figure 10:
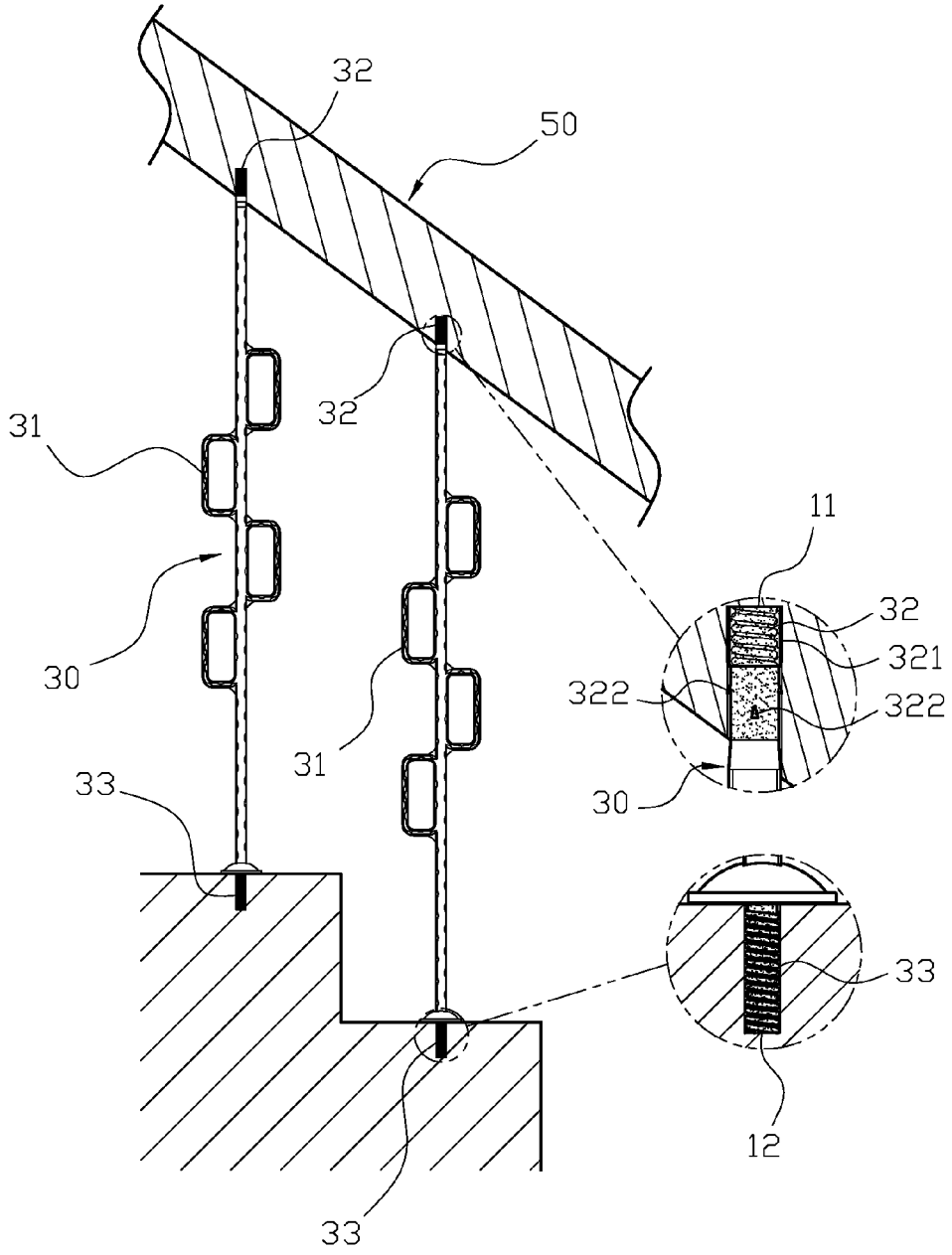
FIG. 10 is a third schematic view of the hand railing in the present invention.

Referring to FIGS. 8 to 10, when in use, the metal rod 10 can be secured through the screw section 33 at the second end 12 at an edge of a terrace or a stair with heights, and the ring section 32 of the first end 11 plugs into a railing rod 50. FIGS. 8 and 9 specially show the usage of the present invention at the terrace, and the stopping portion 31 is used to protect the plastic cover. FIG. 10 especially shows the usage of the present invention at the stairs, and the ring section 32 plugs into the railing rod 50 to increase the engaging areas between the ring section 32 and the railing rod 50, and the reverse hook block 322 is used to apply certain pressure to the railing rod 50 to prevent it from separating. Also, the reverse hook block 322 and the longitudinal section 321 are used to achieve an anti-rotating effect to increase the engaging strength between the metal rod 10 and the railing rod 50.

Figure 14:
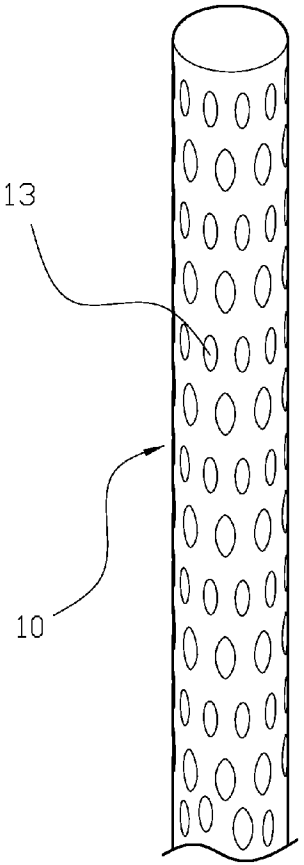
FIG. 14 is a schematic view of a fourth metal rod style in the present invention.
Figure 13:
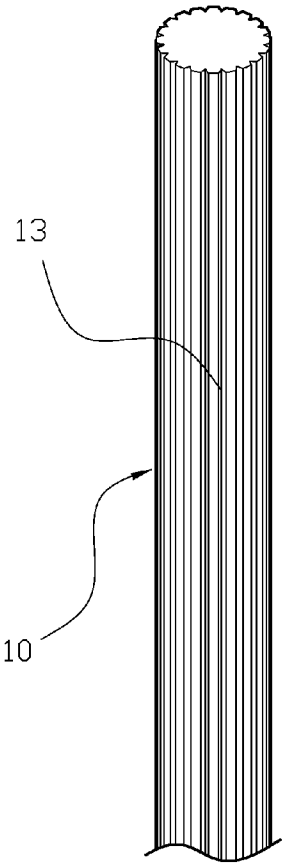
FIG. 13 is a schematic view of a third metal rod style in the present invention.
Figure 12:
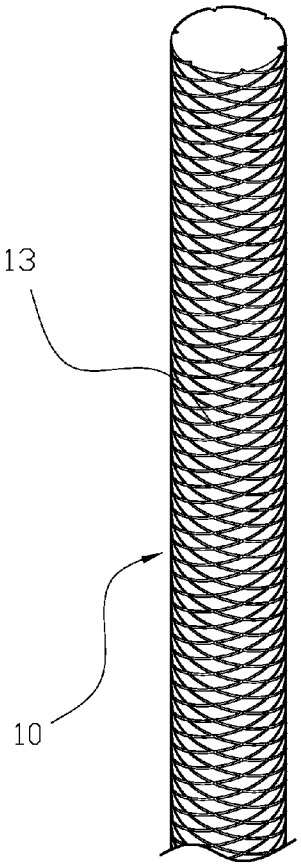
FIG. 12 is a schematic view of a second metal rod style in the present invention.
Figure 11:
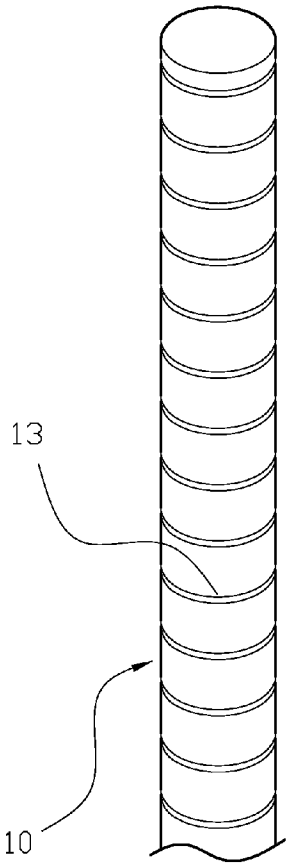
FIG. 11 is a schematic view of a first metal rod style in the present invention.
Figure 15:
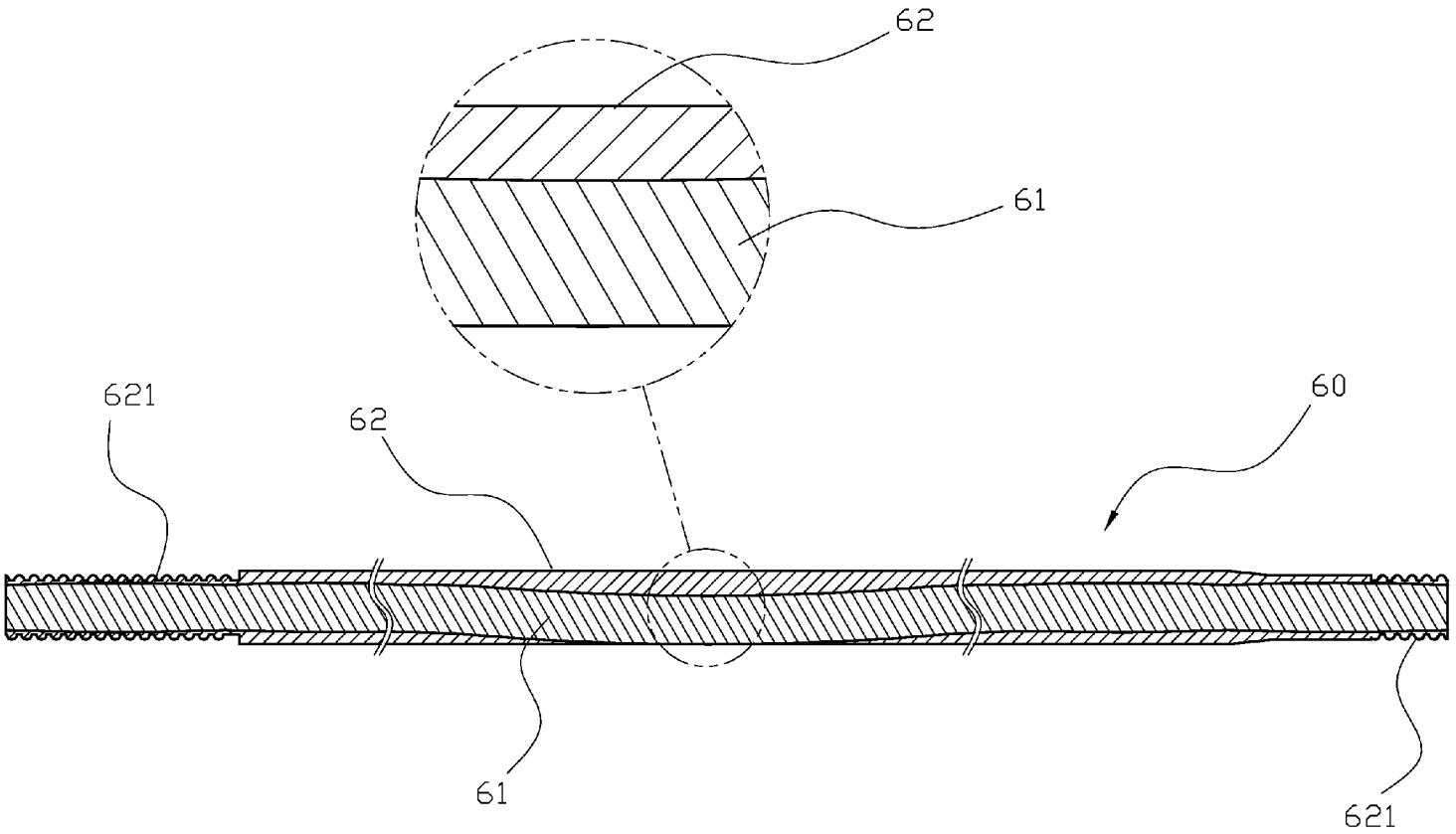
FIG.15 PRIOR ART
FIG. 15 is a prior art.

Referring to FIG. 11, the recessed slot 13 of the metal rod 10 is a spaced ring recessed slot from the first end 11 to second end 12. Referring to FIGS. 12 and 13, the recessed slot 13 can cross with each other. Referring to FIG. 14, the recessed slot 13 can be evenly distributed between the first end 11 and second end 12. With the abovementioned designs of the recessed slot 13, the plastic cover 30 can be used to cover the surface of the metal rod 10 and tightly secure thereon.

Comparing with conventional hand railings, the present invention is advantageous because the connecting portion 23 is used to open up the cover bodies 21 and 22, and the arc surfaces 211 and 221 cover the surface of the metal rod 10, so the reverse hook portion 212 and fixed hole 222 are engaged so the positioning units 20 are secured on the surface of the metal rod 10. The metal rod 10 is then placed in the injection mold 40, and the positioning unit 20 is disposed between the metal rod 10 and injection mold 40. Meanwhile, the melted plastic cover 30 is introduced into the mold 40 to fill the mold 40 including the recessed portions 25 and melt the surface of the positioning unit 20, so the plastic cover 30 can completely cover the metal rod 10 and the positioning unit 20. Furthermore, since the melted plastic cover 30 also flows into recessed slot 13, the engagement between the metal rod 10 and plastic cover 30 is even stronger. The manufacturing yield can also be increased because of the positioning units 20.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A hand railing comprising:

a metal rod having a first end and a second end, and a recessed slot formed on a surface of said metal rod extending from said first end to the second end;

a plurality of positioning units having a pair of cover bodies symmetrically formed on both sides of the positioning unit, and a resilient connecting portion used to connect the cover bodies; a concave arc surface formed on the side that the cover bodies face each other; the cover body having a reverse hook portion while the cover body having a fixed hole; the concave arc surfaces are used to attach to the surface of the metal rod, and the reverse hook portion plugs into the fixed hole to secure the positioning unit on the metal rod; and a plastic cover, wherein the metal rod is adapted to be disposed in a mold during an injection molding process and the positioning unit is adapted to be disposed between the mold and the metal rod, and a plurality of recessed portions are formed on the surface of the positioning unit so that the plastic cover, when it is melted, flows to cover an outer surface of the metal rod and flows into the recessed slot, and a ring section of the plastic cover is formed at the first end of the metal rod while a screw section is formed at the second end of the metal rod, and the ring section and the screw section are arranged to form the hand railing and a stopping portion is used as a protection thereof.

2. The hand railing of claim 1, wherein the recessed slot is a continuously slanted slot extending from the first end to the second end.

3. The hand railing of claim 1, wherein the recessed slot is a spacedly-arranged ring recessed slot extending from the first end to the second end.

4. The hand railing of claim 1, wherein the recessed slot crosses with each other extending from the first end to the second end.

5. The hand railing of claim 1, wherein the recessed slot is a straight recessed slot extending from the first end to the second end.

6. The hand railing of claim 1, wherein the recessed slots are evenly distributed between the first end and second end.

7. The hand railing of claim 1, wherein a plurality of recessed portions are formed on a surface of the positioning unit to facilitate the flow of the plastic cover.

8. The hand railing of claim 1, wherein at least one protruding particle is formed on the arc surfaces to insert into the recessed slot on the metal rod to further secure the positioning unit on the metal rod.

9. The hand railing of claim 1, wherein the plastic cover has a plurality of stopping portions formed on both sides of the metal rod.

10. The hand railing of claim 1, wherein a longitudinal section is protrudingly formed on the metal rod from the ring section, and a plurality of reverse hook blocks are protrudingly formed near the ring section.

* * * * *